US008547302B2

(12) United States Patent
Kim

(10) Patent No.: US 8,547,302 B2
(45) Date of Patent: Oct. 1, 2013

(54) ORGANIC LIGHT EMITTING DISPLAY APPARATUS AND METHOD OF DRIVING THE SAME

(75) Inventor: Hyeong-Gwon Kim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1617 days.

(21) Appl. No.: 11/701,457

(22) Filed: Feb. 2, 2007

(65) Prior Publication Data

US 2008/0068312 A1 Mar. 20, 2008

(30) Foreign Application Priority Data

Sep. 18, 2006 (KR) ..... 10-2006-0090145

(51) Int. Cl.
*G09G 3/30* (2006.01)

(52) U.S. Cl.
USPC ..... 345/76; 345/84; 345/690

(58) Field of Classification Search
USPC ..... 345/36, 38–39, 45–48, 76–77, 81–84, 345/87–90, 204, 207, 214, 690, 698–699
See application file for complete search history.

(56) References Cited

U.S. PATENT DOCUMENTS 7,773,057 B2 * 8/2010 Choi et al. ..... 345/77
8,031,964 B2 * 10/2011 Borel et al. ..... 382/266
2005/0057191 A1 * 3/2005 Jo et al. ..... 315/291
2005/0190164 A1 * 9/2005 Velthoven et al. ..... 345/204
2005/0253835 A1 * 11/2005 Kawase ..... 345/207
2006/0125734 A1 * 6/2006 Cok et al. ..... 345/76
2006/0202934 A1 9/2006 Shin et al.
2007/0085781 A1 * 4/2007 Chung et al. ..... 345/76
2009/0102761 A1 * 4/2009 Akimoto et al. ..... 345/76

FOREIGN PATENT DOCUMENTS

KR 10-2004-0087427 10/2004

OTHER PUBLICATIONS

KIPO Registration Determination Certificate dated Jan. 3, 2008, for Korean priority Patent application 10-2006-0090145, (4 pages).

* cited by examiner

*Primary Examiner* — William Boddie
*Assistant Examiner* — Mansour M Said
(74) *Attorney, Agent, or Firm* — Christie, Parker & Hale, LLP

(57) ABSTRACT

An organic light emitting display apparatus minimizes brightness reduction and power consumption increase, and can remove motion blurring. The organic light emitting display apparatus includes a plurality of pixels, each including an organic light emitting device and a pixel circuit, a data driving unit to apply a data signal to data lines connected to the pixels, a scan driving unit to apply a selection signal to selection scan lines connected to the pixels, an emission signal generating unit to generate a first emission signal, an emission duty controlling unit to calculate basic information to reduce motion blurring and to generate an emission duty control signal based on the basic information, a logic gate to output a second emission signal by receiving the first emission signal and the emission duty control signal, and an emission driving unit to apply the second emission signal to emission scan lines connected to the pixels.

20 Claims, 10 Drawing Sheets

Relationship Between the Light Emitting Period and the Reduction in Motion Blurring

ORGANIC LIGHT EMITTING DISPLAY APPARATUS AND METHOD OF DRIVING THE SAME

CROSS-REFERENCE TO RELATED APPLICATION

This application claims the benefit of Korean Application No. 2006-90145, filed on Sep. 18, 2006 in the Korean Intellectual Property Office, the disclosure of which is incorporated herein by reference.

BACKGROUND OF THE INVENTION

1. Field of the Invention

Aspects of the present invention relate to an organic light emitting display apparatus which can minimize brightness reduction, minimize an increase in power consumption, and reduce or remove motion blurring, and a method of driving the organic light emitting display apparatus.

2. Description of the Related Art

In general, light emitting display apparatuses display images using self-emissive devices. Such light emitting display apparatuses are classified into inorganic light emitting display apparatuses having a light emitting layer formed of an inorganic material, and organic light emitting display apparatuses having a light emitting layer formed of an organic material.

In an organic light emitting display apparatus, electrons and holes are injected into an organic thin film through cathodes and anodes, and are recombined to form excitons or photons to emit light having a specific wavelength. The organic thin film has a multi-layer structure including a hole transport layer, a light emitting layer, and an electron transport layer, to improve the light-emitting efficiency. Also, the organic thin film includes an electron injection layer, a hole injection layer, or something similar, to improve the injection efficiency of electrons or holes and to distribute the electrons and holes uniformly.

Methods of driving the organic light emitting display apparatus are classified into a passive matrix method and an active matrix method. In the passive matrix method, lines are formed to intersect each other when anodes and cathodes are formed in an organic light emitting display apparatus. The lines are then sequentially selected and driven. The organic light emitting display apparatus driven as such by way of the passive matrix method has a simple structure which can be easily implemented. However, an organic light emitting display apparatus operated using the passive matrix method consumes large amounts of power when used to drive a large screen, and a driving (or light emitting) time of each light emitting device is short.

In the active matrix method, on the other hand, the amount of current which flows through respective light emitting devices is controlled using active devices. The active devices may be thin film transistors (TFTs). An organic light emitting display apparatus operated using the active matrix method consumes small amounts of power and has a long driving (or light emitting) time. However, the organic light emitting display apparatus operated using the active matrix method has a motion blurring problem.

Motion blurring is a phenomenon in which pictures (or images) overlap or appear blurry when pictures move on the screen. Motion blurring affects organic light emitting display apparatuses and liquid crystal display apparatuses that use the active matrix method of operation. However, impulse type display apparatuses, such as cathode ray tubes (CRT), are not affected by motion blurring effects.

In impulse type display apparatuses, after-images (blurry images) are reduced by momentarily displaying light corresponding to an amount of brightness required to display each pixel, as illustrated in FIG. 1. In the case of hold type display apparatuses, after-images are easily increased by continuously displaying light corresponding to an amount of brightness required to display each pixel during a constant time period, as illustrated in FIG. 2.

In order to reduce motion blurring in the hold type display apparatuses, a driving method similar to the driving method of the impulse type display apparatuses, such as the CRT display, has been developed. FIG. 3 is a graph illustrating one impulse type driving method that is applied to a related art hold type display apparatus. Referring to FIG. 3, to drive the hold type display apparatus, black frame images are inserted between successive frame images in order to mimic the impulse type driving method.

However, such a driving method suffers from a reduction in an average brightness of the entire screen by the amount of the inserted black frame images. To address this problem, a current flowing through light-emitting diodes of the hold type display apparatus is increased when moving pictures are to be displayed. However, increasing current flow increases power consumption.

SUMMARY OF THE INVENTION

Aspects of the present invention are directed to an organic light emitting display apparatus which can minimize brightness reduction, minimize an increase in power consumption, and reduce or remove motion blurring, and a method of driving the organic light emitting display apparatus.

According to an aspect of the present invention, an organic light emitting display apparatus includes: a plurality of pixels, each of the pixels including an organic light emitting device and a pixel circuit; a data driving unit to apply a data signal to data lines connected to the pixels; a scan driving unit to apply a selection signal to selection scan lines connected to the pixels; an emission signal generating unit to generate a first emission signal; an emission duty controlling unit to calculate basic information to reduce motion blurring and generate an emission duty control signal based on the basic information; a logic gate to output a second emission signal based on the received first emission signal and the emission duty control signal; and an emission driving unit to apply the second emission signal to emission scan lines connected to the pixels.

The emission duty controlling unit may include: a data variation calculating unit to measure a variation of the data signal; and an emission duty control signal generating unit to generate an emission duty control signal based on the variation of the data signal.

The emission duty controlling unit may generate the emission duty control signal to provide lower emission duty corresponding to higher variation of the data signal.

The emission duty controlling unit may include: a brightness calculating unit to calculate each frame brightness of the data signal; and an emission duty control signal generating unit to generate an emission duty control signal based on the frame brightness of the data signal.

The emission duty controlling unit may generate the emission duty control signal to provide lower emission duty corresponding to higher frame brightness.

The emission duty controlling unit may include: an external illumination calculating unit to measure external illumination of the organic light emitting display apparatus; and an emission duty control signal generating unit to generate an emission duty control signal based on the external illumination.

The emission duty controlling unit may generate the emission duty control signal to provide lower emission duty corresponding to higher external illumination.

The logic gate may be an OR gate.

The selection scan lines may include a first selection scan line and a second selection scan line, the pixel circuit may include a first switching transistor, a second switching transistor, a first capacitor, a second capacitor, and a driving transistor, wherein the first switching transistor may transmit a data voltage that is applied to the data line in response to a first selection signal applied to the first selection scan line, the first capacitor may store a voltage corresponding to a threshold voltage of the driving transistor, the second capacitor may store a voltage corresponding to the data voltage transmitted from the first switching transistor, the second switching transistor may connect a power supply line to a terminal of the first capacitor in response to a second selection signal applied to the second selection scan line, and the driving transistor may supply a current from the power supply line to the organic light emitting device in correspondence to the voltages stored in the first and second capacitors.

The pixel circuit may further include a third switching transistor which diode-connects the driving transistor in response to the second selection signal.

The pixel circuit may further include a fourth switching transistor to break the connection between the driving transistor and the organic light emitting diode in response to an emission signal applied to the emission scan line.

According to another aspect of the present invention, a method of driving an organic light emitting display apparatus includes: generating a first emission signal; calculating basic information to reduce motion blurring; generating an emission duty control signal based on the basic information; generating a second emission signal from the first emission signal and the emission duty control signal; and selectively reducing the motion blurring by controlling an emission duty of an organic light emitting device using the second emission signal.

The basic information to reduce the motion blurring may be a variation of a data signal applied to data lines of the organic light emitting display apparatus.

The emission duty control signal may provide lower emission duty corresponding to higher variation of the data signal.

The basic information for reducing the motion blurring may be frame brightness of the data signal applied to the data lines of the organic light emitting display apparatus.

The emission duty control signal may provide lower emission duty corresponding to higher frame brightness.

The basic information to reduce the motion blurring may be an external illumination of the organic light emitting display apparatus.

The emission duty control signal may provide lower emission duty corresponding to higher external illumination.

The second emission signal may be generated by an OR operation of the first emission signal and the emission duty control signal.

According to an aspect of the present invention, an organic light emitting display apparatus, includes at least one pixel; a data driver to apply a data signal to the at least one pixel; a scan driver to apply a selection signal to the at least one pixel; and an emission driver to apply an emission signal to the at least one pixel, wherein the emission signal having been generated using a filter signal to control an amount of light emitting period of the emission signal.

According to an aspect of the present invention, an organic light emitting display apparatus includes: an emission duty controller; and an image display, the image display comprising an organic light emitting diode (OLED), and a first transistor, a second transistor, a third transistor, a fourth transistor, and a driving transistor, each having a gate, a source, and a drain, wherein: the drain of the first transistor is connected to the drain of the second transistor; the source of the second transistor is connected to the source of the driving transistor; the drain of the third transistor is connected to the gate of the driving transistor and the source of the third transistor is connected to the drain of the of the driving transistor to diode-connect the driving transistor; the source of the third transistor is also connected to the source of the fourth transistor; and the drain of the fourth transistor is connected to the OLED.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the aspects, taken in conjunction with the accompanying drawings of which.

DETAILED DESCRIPTION OF THE EMBODIMENTS

Figure 1:
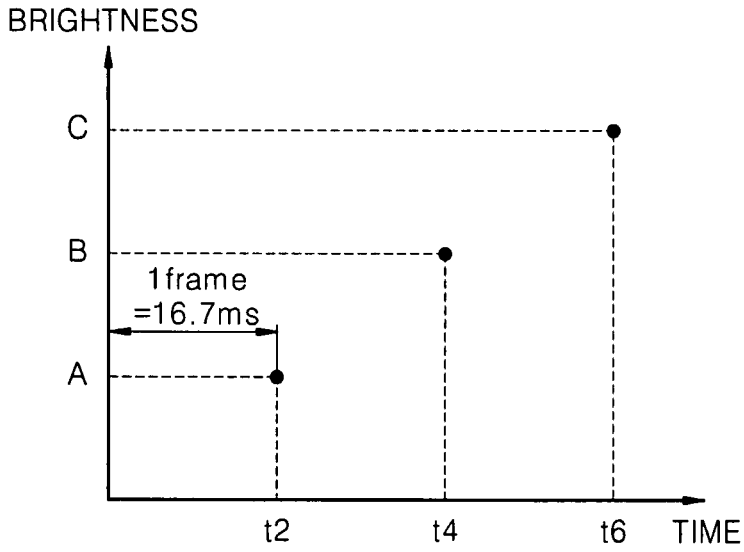
FIG. 1 (RELATED ART)
FIG. 1 is a graph for explaining a display method performed in a related art impulse type display apparatus.
Figure 2:
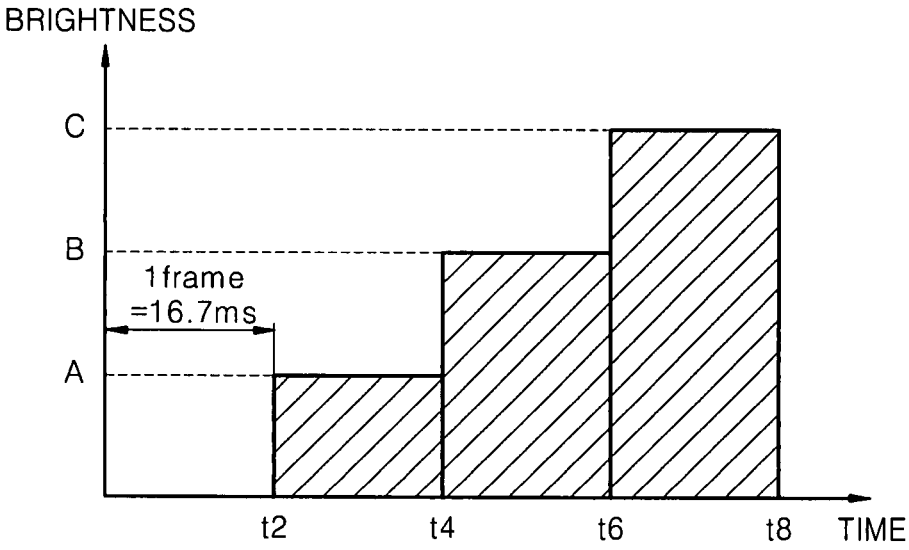
FIG. 2 (RELATED ART)
FIG. 2 is a graph for explaining a display method performed in a related art hold type display apparatus.
Figure 3:
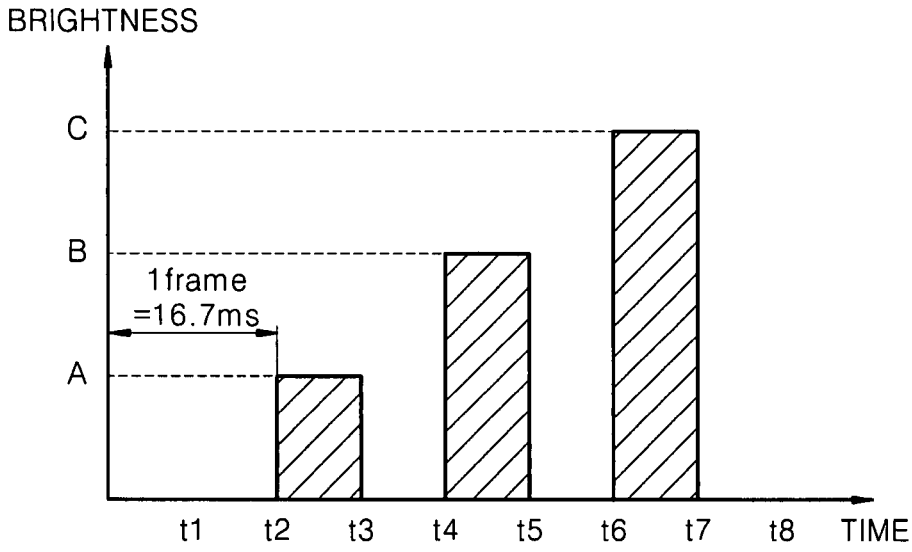
FIG. 3 (RELATED ART)
FIG. 3 is a graph illustrating an example in which an impulse type driving method is applied to a related art hold type display apparatus.

Reference will now be made in detail to aspects of the present invention, examples of which are illustrated in the accompanying drawings, wherein like reference numerals refer to the like elements throughout. The aspects are described below in order to explain the present invention by referring to the figures.

Figure 4:
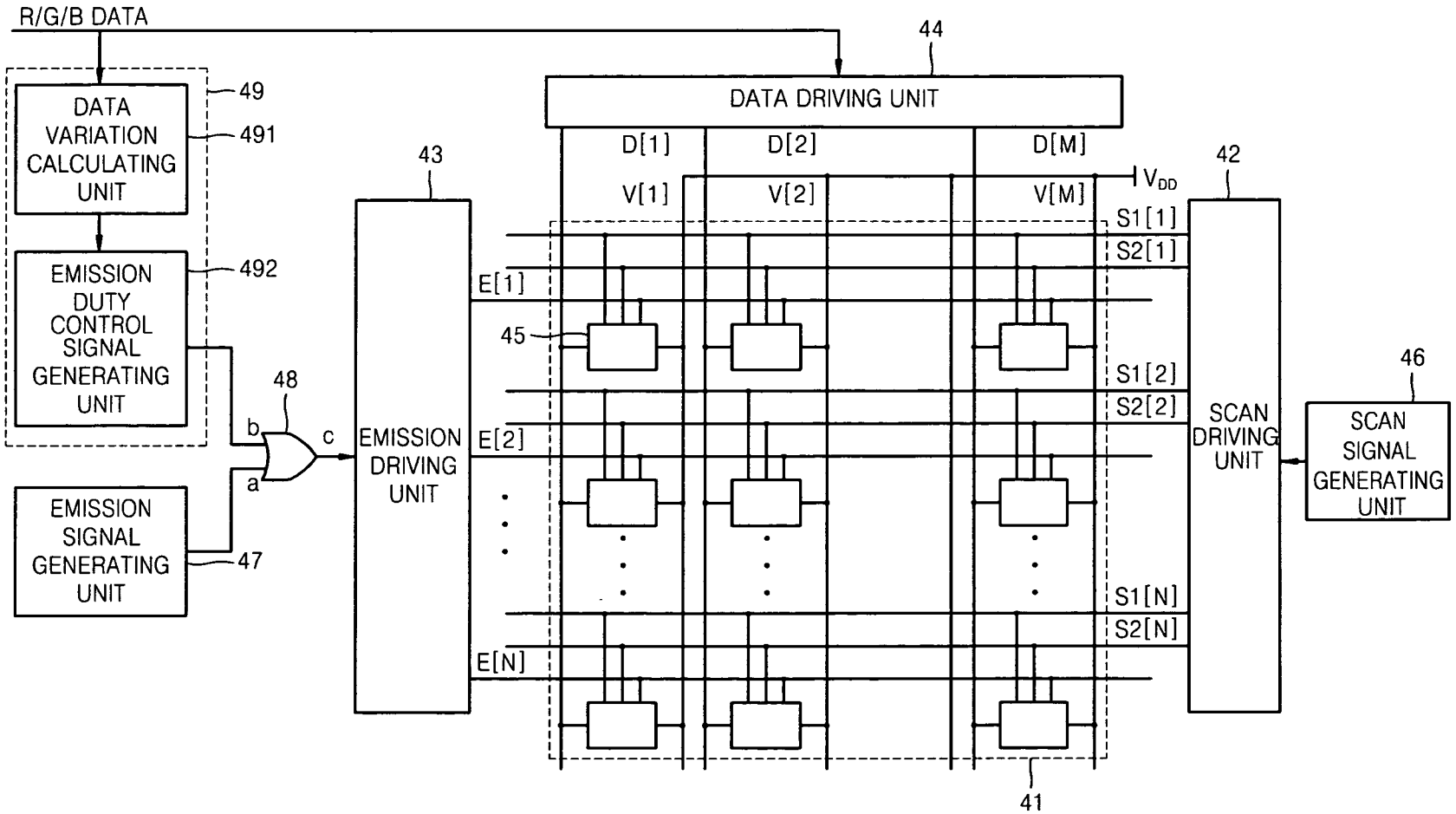
FIG. 4 is a block diagram of an organic light emitting display apparatus according to an aspect of the present invention.

FIG. 4 is a block diagram of an organic light emitting display apparatus according to an aspect of the present invention. Referring to FIG. 4, the organic light emitting display apparatus includes an image displaying unit 41, a scan driving unit 42, an emission driving unit 43, a data driving unit 44, a scan signal generating unit 46, an emission signal generating unit 47, an OR gate 48, and an emission duty controlling unit 49.

The image displaying unit 41 includes N×M pixels 45, N first scan lines S1[1] through S1[N], N second scan lines S2[1] through S2[N], and N emission scan lines E[1] through E[N] formed in a row direction, M data lines D[1] through D[M], and M power supply lines V[1] through V[M] formed in a column direction. In various aspects, N and M are whole numbers. In various aspects, N and M may be a same number or different numbers.

Each of the pixels 45 (or each pixel 45) includes an organic light emitting device and a pixel circuit. The first scan lines S1[1] through S1[N], the second scan lines S2[1] through S2[N], and the emission scan lines E[1] through E[N] transfer a first selection signal, a second selection signal, and an emission signal, respectively, to the pixels 45. Also, the data lines D1[1] through D[M] and the power supply lines V[1] through V[M] transfer a data signal and a supply voltage, respectively, to the pixels 45.

The data driving unit 44 receives RGB data (red, green, and/or blue data) and applies signal of the data to each of the data lines D1 through D[M]. The data signal can be outputted from a voltage source or a current source in the data driving unit 44.

The scan signal generating unit 46 generates and outputs the first selection signal and the second selection signal to the scan driving unit 42.

The scan driving unit 42 applies the first selection signal and the second selection signal to the first scan lines S1[1] through S1[N] and the second scan lines S2[1] through S2[N], respectively. The first and second selection signals are sequentially applied to the first scan lines S1[1] through S1[N] and the second scan lines S2[1] through S2[N], respectively. The data signal is applied to a pixel circuit in synchronization with the first and second selection signals.

The emission signal generating unit 47 generates a first emission signal. In a non-limiting aspect, the first emission signal has a fixed pattern. For example, the first emission signal may be an emission signal d[m] illustrated in FIG. 8, which repeats during each frame. In other aspects, the first emission signal may be a desired pattern or a non-pattern.

The emission duty controlling unit 49 calculates basic information to reduce motion blurring and generates an emission duty control signal based on the basic information. In various aspects, motion blurring is blurring of an image that is displayed due to rapid changing of the image. The emission duty represents a rate of light emitting period per one frame (or an amount and/or a length of the light emitting period per one frame). In a non-limiting aspect of the present invention, as the emission duty is reduced, motion blurring and/or brightness is also reduced. In various aspects, the emission duty represents a time window when light may be emitted. Accordingly, the emission duty controlling unit may be considered a filter.

Figure 12:
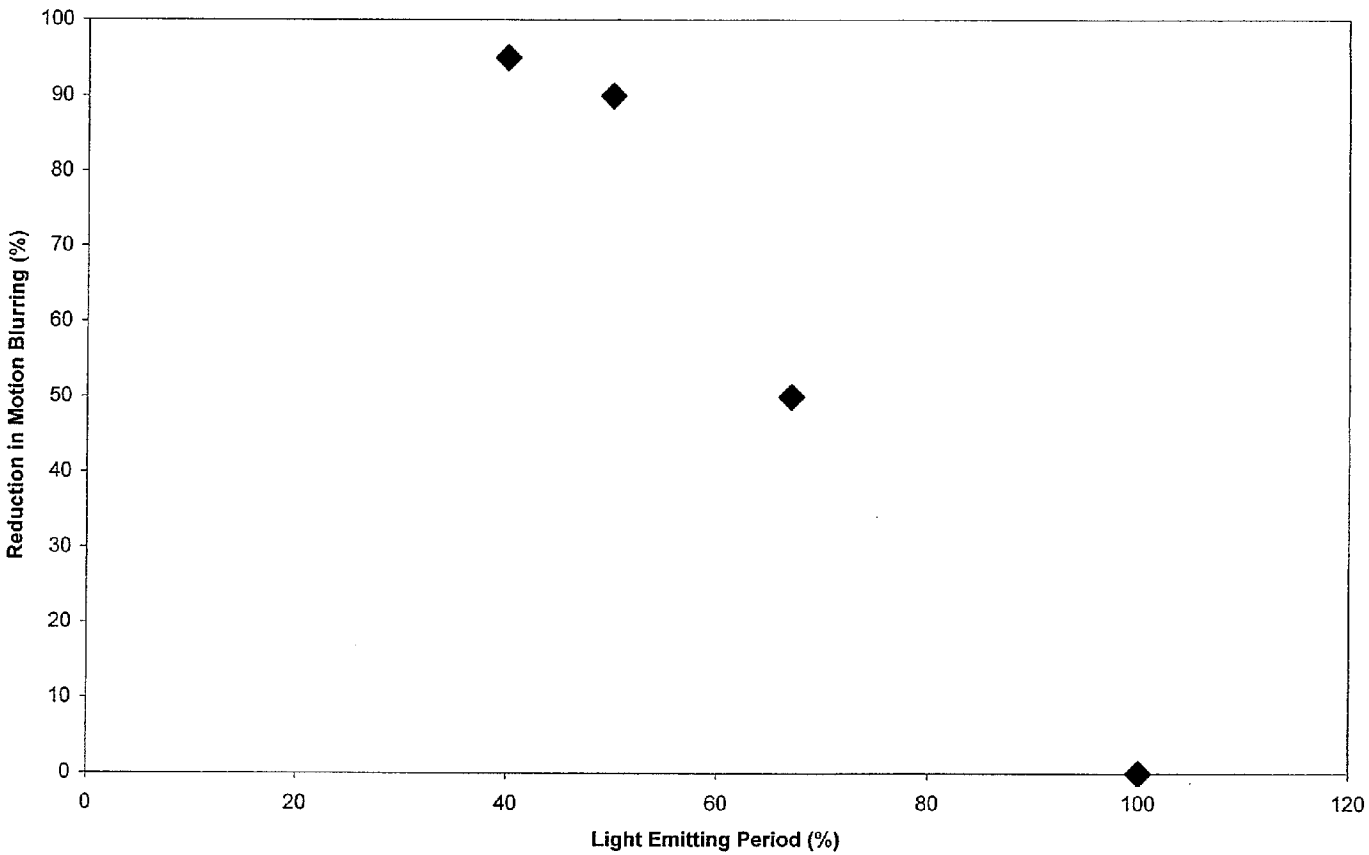
FIG. 12 is a graph illustrating a relationship between the light emitting period and the reduction in the motion blurring according to an aspect of the present invention.

According to non-limiting aspects of the present invention, when the emission duty is 100%, there is no reduction in the motion blurring. As shown in FIG. 12, when the emission duty is 67%, the motion blurring is reduced by 50%, when the emission duty is 50%, the motion blurring is reduced by 90%, and when the emission duty is 40%, the motion blurring is reduced by 95%. Accordingly, in this aspect, there is a non-linear relationship between the emission duty and the reduction in the motion blurring. In other aspects, the relationship may be linear. In various aspects, other relationships are possible.

In the aspect shown in FIG. 4, the emission duty controlling unit 49 includes a data variation calculating unit 491 and an emission duty control signal generating unit 492.

The data variation calculating unit 491 measures variation of the data signal. The data signal may be the RGB data inputted to the data driving unit 44 and/or data signal of one frame inputted to each of the data lines D[1] through D[M].

In a non-limiting aspect shown, the variation of the data signal represents the speed of change of an image on the display. For a static image, the variation of the data signal is small, but for a moving image, the variation of the data signal is high. Further, there is higher variation of the data signal for an image having a faster speed of change.

In the non-limiting aspect, the variation of the data signal can be obtained by calculating pixel data of each frame and comparing the calculated pixel data. Also, the variation of the data signal can also be obtained by detecting a movement of edges from data of a moving image, for example.

The emission duty control signal generating unit 492 generates the emission duty control signal based on the variation of the data signal. The emission duty controlling unit 49 generates the emission duty control signal to provide lower emission duty corresponding to the increase in the variation of the data signal (that is, the higher the variation, the lower the emission duty). Also, the emission duty controlling unit 49 does not generate the emission duty control signal when the variation of the data signal is below a predetermined standard (or level), but generates a fixed emission duty control signal when the variation of the data signal exceed the predetermined standard. In various aspects, the emission duty control signal may be generated when the variation of the data signal is between a first predetermined standard and a second predetermined standard, and/or may be generated without regard to the predetermined standards.

The logic gate 48 outputs a second emission signal by receiving the first emission signal and the emission duty control signal. Preferably, although not required, the logic gate 48 may be an OR gate or an equivalent structure.

The emission driving unit 43 applies the second emission signal to the emission scan lines E[1] through E[N] connected to the pixels 45. By way of the second emission signal, a driving current is applied to the organic light emitting device based on a voltage stored in a storage device (such as a capacitor) in the pixel circuit. Accordingly, the organic light emitting device emits light.

In a related art, in order to reduce the motion blurring effect, a light emitting period is controlled without regards to the speed of a moving image. Accordingly, an average display brightness of the overall display (or panel) is decreased.

On the other hand, according to aspects of the present invention, when a static image and a moving image are inputted together and/or when a moving image having a signal with an operating speed (or changing speed) exceeds a predetermined limit, the duty of an emission signal is controlled in order to control the light emitting time occurring per one frame. Thus, motion blurring caused by displaying a moving image can be selectively reduced and/or avoided. In addition, a reduction of an overall average brightness can be minimized along with the reduction in the motion blurring.

In various aspects, the scan driving unit 42, the emission driving unit 43, and/or the data driving unit 44 can be electrically connected to an image displaying unit 41, such as a display panel, through wire bonding, etc. In other aspects, the scan driving unit 42, the emission driving unit 43, and/or the data driving unit 44 can be mounted as chips on a tape carrier package (TCP), etc., which can be attached and electrically connected to the image display unit 41. Also, the scan driver 42, the emission driver 43, and/or the data driver 44 can be mounted as chips on a flexible printed circuit (FPC) or a film, etc., which can be attached and electrically connected to the image display unit 41. Such a structure is generally called a chip on film (COF) structure. In a non-limiting aspect, the scan driver 42, the emission driver 43, and/or the data driver 44 can be directly mounted on a glass substrate of the image display unit 41, or can be installed in a driving circuit which includes scan lines, data lines, and thin film transistors (TFTs) formed on the glass substrate. In various other aspects, the substrate may be non-glass, such as ceramic, thin metal, and/or polymer, or something similar.

Figure 5:
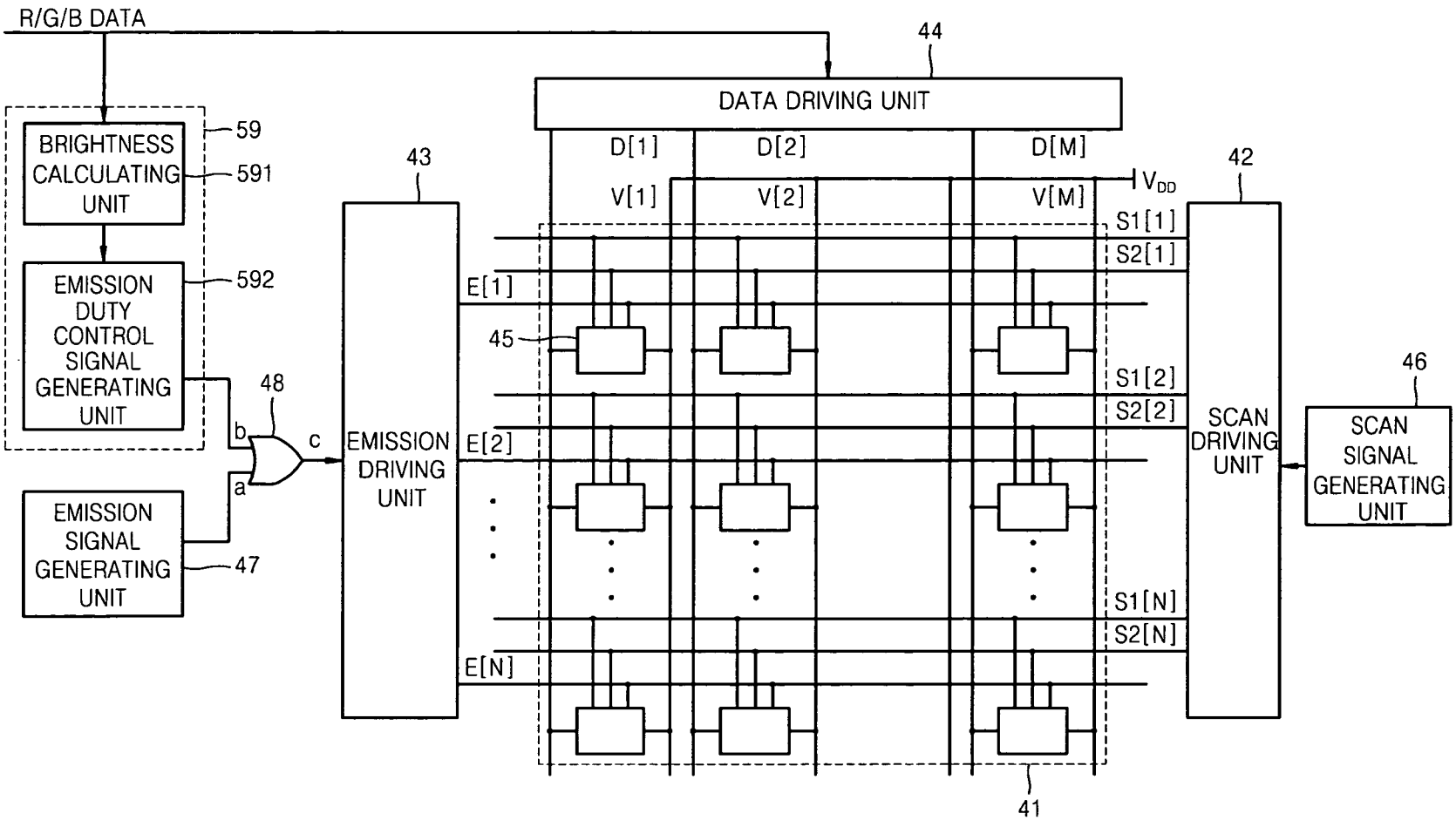
FIG. 5 is a block diagram of an organic light emitting display apparatus according to another aspect of the present invention.

FIG. 5 is a block diagram of an organic light emitting display apparatus according to another aspect of the present invention. Hereinafter, descriptions of the organic light emitting display apparatus according to aspects of the present invention will focus on parts of the organic light emitting display apparatus that differ from the organic light emitting display apparatus of FIG. 4.

In the aspect shown in FIG. 5, an emission duty controlling unit 59 includes a brightness calculating unit 591 and an emission duty control signal generating unit 592. The brightness calculating unit 591 calculates each frame brightness of the data signal. The data signal may be RGB data inputted to the data driving unit 44 and/or a data signal of one frame inputted to each of the data line D[1] through D[M].

The emission duty control signal generating unit 592 generates the emission duty control signal based on the frame brightness of the data signal. The emission duty controlling unit 59 generates the emission duty control signal to provide lower emission duty corresponding to the increase in the frame brightness of the data signal (that is, the higher the frame brightness, the lower the emission duty). Also, the emission duty controlling unit 59 does not generate the emission duty control signal when the frame brightness of the data signal is below a predetermined standard (or level), but generates a fixed emission duty control signal when the frame brightness of the data signal exceed the predetermined standard (or level). In various aspects, the emission duty control signal may be generated when the frame brightness of the data signal is between a first predetermined standard and a second predetermined standard, and/or may be generated without regard to the predetermined standards.

According to this aspect of the present invention, when an image having a high brightness is displayed, even though some brightness may be sacrificed in order to reduce motion blurring, a user is unable to perceive (or is insensitive to) any reduction in the image quality caused by reduction in the brightness.

Figure 6:
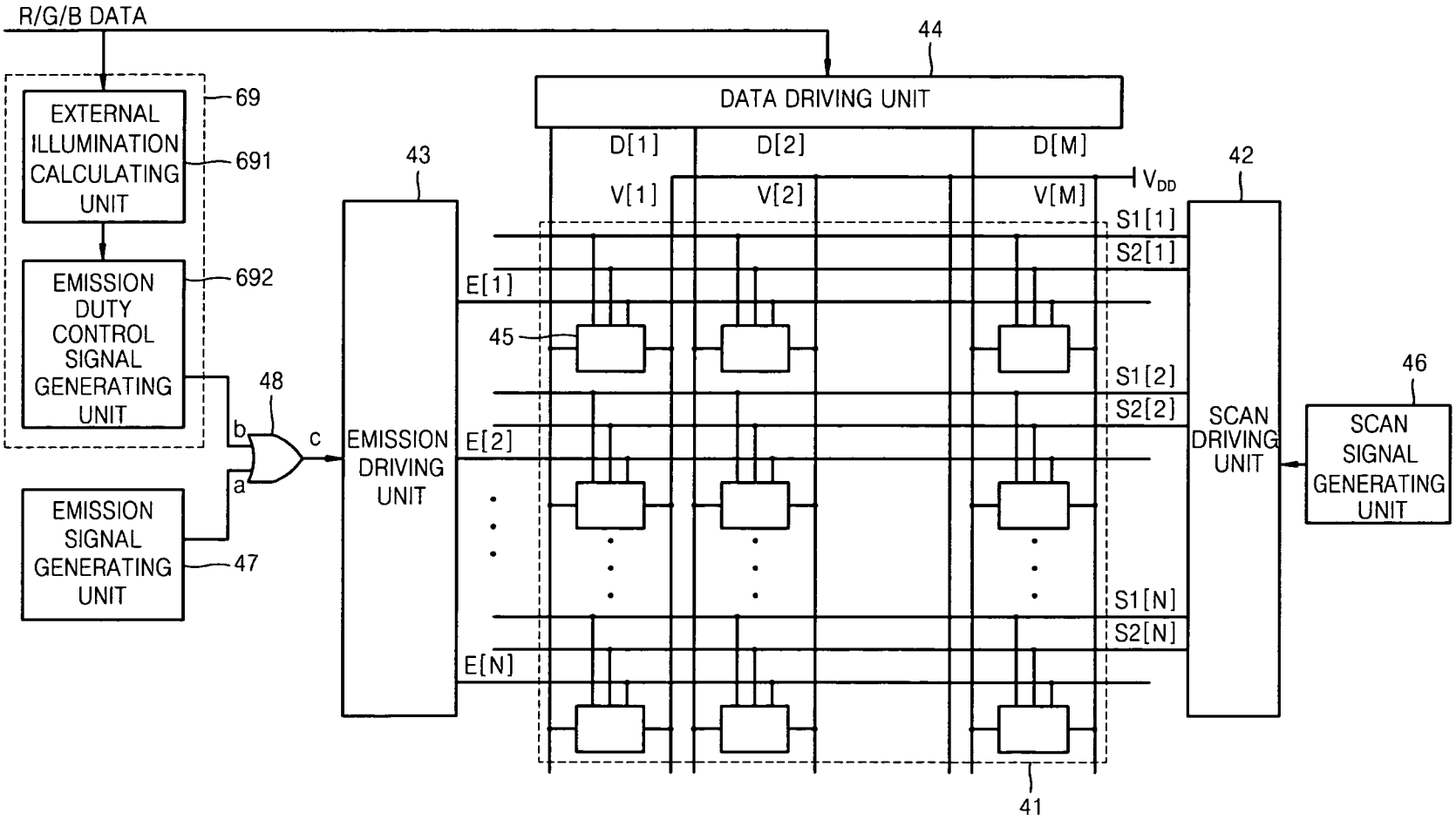
FIG. 6 is a block diagram of an organic light emitting display apparatus according to another aspect of the present invention.

FIG. 6 is a block diagram of an organic light emitting display apparatus according to another aspect of the present invention. Hereinafter, descriptions of the organic light emitting display apparatus according to aspects of the present invention will focus on parts of the organic light emitting display apparatus that differ from the organic light emitting display apparatus of FIG. 4.

In the aspect shown in FIG. 6, an emission duty controlling unit 69 includes an external illumination calculating unit 691 and an emission duty control signal generating unit 692. The external illumination calculating unit 691 measures (detects and/or obtains) external illumination level around and/or of the organic light emitting display apparatus. The external illumination level indicates whether a user is in a dark place or a bright place, for example, whether the user is indoors or outdoors. Also, the external illumination level can indicate whether it is day or night. In a non-limiting aspect, the external illumination calculating unit 691 can be a sensor which measures a level of illumination by a general technique.

The emission duty control signal generating unit 692 generates the emission duty control signal based on the external illumination level. The emission duty controlling unit 69 generates the emission duty control signal to provide lower emission duty corresponding to an increase in the external illumination (that is, the higher the variation, the lower the emission duty). Also, the emission duty controlling unit 69 does not generate the emission duty control signal when the external illumination level of the data signal is below a predetermined standard, but generates a fixed emission duty control signal when the external illumination level of the data signal exceeds the predetermined standard. In various aspects, the emission duty control signal may be generated when the external illumination level of the data signal is between a first predetermined standard and a second predetermined standard, and/or may be generated without regard to the predetermined standards.

According to this aspect of the present invention, when an image is displayed on an organic light emitting display apparatus by a user using the display in a bright place, even though some brightness may be sacrificed in order to reduce motion blurring, the, the user is unable to perceive (or is insensitive to) any reduction in the image quality caused by reduction in brightness.

In a non-limiting aspect of the present invention, an organic light emitting display apparatus may include the data variation calculating unit 491, the brightness calculating unit 591, the external illumination calculating unit 691, or any combinations thereof to receive the RGB data signal, and to respectively forward the variation, the brightness, and the external illumination level of the data signal to the emission duty control signal generating unit. The emission duty control signal generating unit will then generate the emission duty control signal based on one or more of the received data signals.

Figure 7:
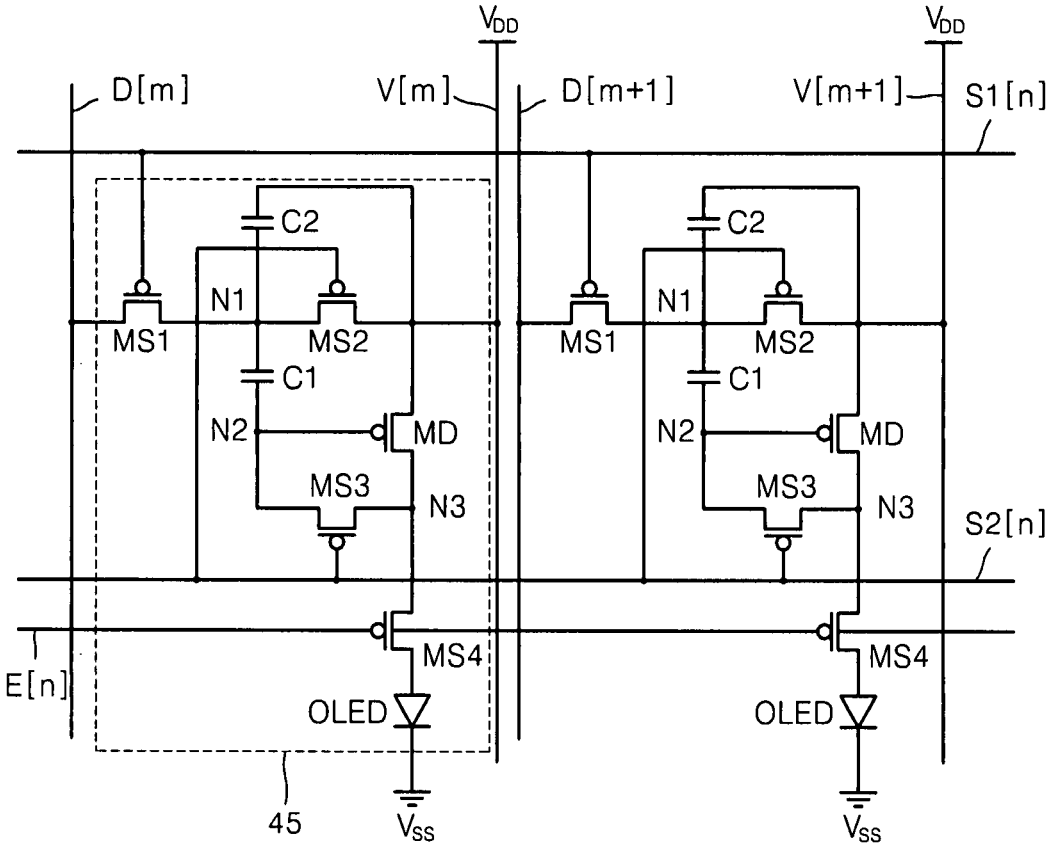
FIG. 7 is a circuit diagram of a pixel which can be used in the organic light emitting display apparatus illustrated in anyone of FIGS. 4 through 6, according to aspects of the present invention.

FIG. 7 is a circuit diagram of a pixel 45 which can be used in the organic light emitting display apparatus illustrated in any one of FIGS. 4 through 6, according to an aspect of the present invention.

Referring to FIG. 7, the pixel 45 includes an organic light emitting diode (OLED) and a pixel circuit. The pixel circuit includes a driving transistor MD, first through fourth switching transistors MS1, MS2, MS3, and MS4, and first and second capacitors C1 and C2. The driving transistor MD and the first through fourth switching transistors MS1, MS2, MS3, and MS4 each includes a gate, a source, and a drain. The first and second capacitors C1 and C2 each include a first terminal and a second terminal.

As shown in FIG. 7, the gate of the first switching transistor MS1 is connected to a first scan line S1[*n*], the source of the first switching transistor MS1 is connected to a data line D[m], and the drain of the first switching transistor MS1 is connected to a first node N1. The first switching transistor MS1 applies a data voltage, which is applied to the data line D[m], to the first node N1 in response to a first selection signal applied to the first scan line S1[*n*].

The gate of the second switching transistor MS2 is connected to a second scan line S2[*n*], the source of the second switching transistor MS2 is connected to a power supply line V[m], and the drain of the second switching transistor MS2 is connected to the first node N1. The second switching transistor MS2 applies a power supply voltage, which is applied to the power supply line V[m], to the first node N1 in response to a second selection signal applied to the second scan line S2[*n*].

The gate of the third switching transistor MS3 is connected to the second scan line S2[*n*], the source of the third switching transistor MS3 is connected to a third node N3, and the drain of the third switching transistor MS3 is connected to a second node N2. The third switching transistor MS3 connects the gate and the drain of the driving transistor MD in response to the second selection signal, applied to the second scan line S2[*n*], in order to diode-connect the driving transistor MD, as shown in FIG. 7.

The gate of the fourth switching transistor MS4 is connected to an emission scan line E[n], the source of the fourth switching transistor MS4 is connected to the third node N3, and the drain of the fourth switching transistor MS4 is connected to the OLED. The fourth switching transistor MS4 supplies a current, passing through the driving transistor MD, to the OLED in response to an emission signal applied to the emission scan line E[n].

The first terminal of the first capacitor C1 is connected to the first node N1, and the second terminal of the first capacitor C1 is connected to the second node N2. When the second and third switching transistors MS2 and MS3 are turned on, the first capacitor C1 stores a charge quantity that corresponds to a threshold voltage of the driving transistor MD. When the second and third switching transistors MS2 and MS3 are turned off, the first capacitor C1 maintains the threshold voltage.

The first terminal of the second capacitor C2 is connected to the power supply line V[m] and the second terminal of the second capacitor C2 is connected to the second node N2. When the first switching transistor MS1 is turned on, the second capacitor C2 stores a charge quantity that corresponds to a voltage obtained by subtracting the data voltage from the power supply voltage. When the first switching transistor MS1 is turned off, the second capacitor C2 maintains the voltage obtained by subtracting the data voltage from the power supply voltage.

The gate of the driving transistor MD is connected to the second node N2, the source of the driving transistor MD is connected to the power supply line V[m], and the drain of the driving transistor MD is connected to the third node N3. When the fourth switching transistor MS4 is turned on, the driving transistor MD supplies a current to the OLED that corresponds to a voltage between the first terminal of the second capacitor C2 and the second terminal of the first capacitor C1.

Figure 8:
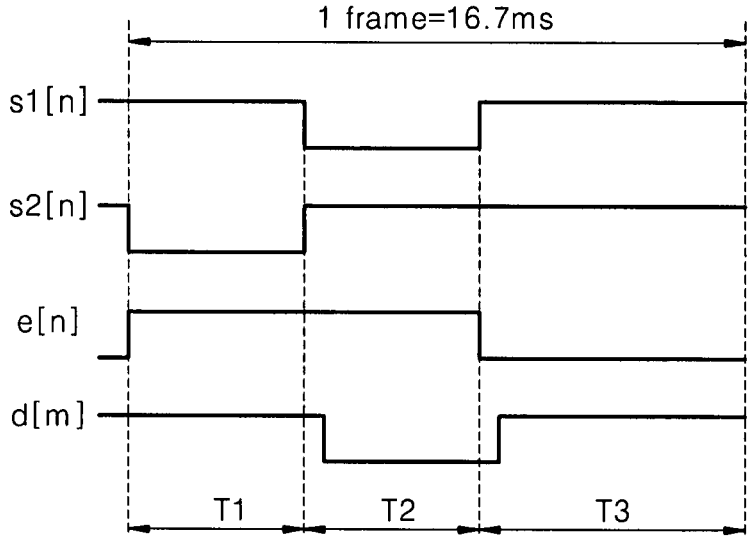
FIG. 8 includes timing diagrams of driving signals that are outputted to the emission scan lines and the first and second selection scan lines to drive a pixel circuit illustrated in FIG. 7.

FIG. 8 includes timing diagrams of driving signals that are outputted to the emission scan line and the first and second selection scan lines to drive the pixel circuit illustrated in FIG. 7.

Referring to FIGS. 7 and 8, during operation of the pixel circuit, one frame of an image has a first period T1, a second period T2, and a third period T3. In various aspects, T1, T2, and T3 may be the same or different from one another.

In the non-limiting aspect shown, during the first period T1, a second selection signal s2[*n*] is low, whereas a first selection signal s1[*n*] and an emission signal e[n] are high. Accordingly, when the respective signals are applied to the pixel circuit of FIG. 7, the second and third switching transistors MS2 and MS3 are turned on, whereas first and fourth switching transistors MS1 and MS4 are turned off. With the above arrangement, a current flowing through a driving transistor MD becomes 0. Accordingly, a voltage $V_{GS}$ between a gate and a source of the driving transistor MD becomes a threshold voltage, i.e., $-|V_{TH}|$, and voltage of a second terminal of a first capacitor C1 becomes $V_{DD}-|V_{TH}|$. Also, as the second switching transistor MS2 is turned on, a voltage of a first terminal of the first capacitor C1 becomes $V_{DD}$. Accordingly, a voltage between the first and second terminals of the first capacitor C1 becomes $|V_{TH}|$.

During the second period T2, the first selection signal s1[*n*] is low, whereas the second selection signal s2[*n*] and the emission signal e[n] are high. Accordingly, when the respective signals are applied to the pixel circuit of FIG. 7, the first switching transistor MS1 is turned on, whereas the second, third, and fourth switching transistors MS2, MS3, and MS4 are turned off. With the above arrangement, a data voltage (VDATA) is applied to the first terminal of the first capacitor C1. Accordingly, a voltage of the second terminal of the first capacitor C1, which is in a floating status, becomes $V_{DD}-|V_{TH}|$. Also, a charge quantity corresponding to $V_{DD}-V_{DATA}$ is stored between the first and second terminals of the second capacitor C2.

During the third period T3, which is a light emitting period, the emission signal e[n] is low, whereas the first and second selection signals s1[*n*] and s2[*n*] are high. Accordingly, when the respective signals are applied to the pixel circuit of FIG. 7, the fourth switching transistor MS4 is turned on, whereas the first, second, and third switching transistors MS1, MS2, and MS3 are turned off. With the above arrangement, a voltage between the gate and source of the driving transistor MD is maintained at a constant level according to Formula 1 expressed below by the first and second capacitors C1 and C2. Accordingly, a current $I_{OLED}$ that flows through an OLED is given by Formula 2 expressed below.

$$V_{GS}=V_{DATA}-|V_{TH}|-V_{DD} \quad \text{<Formula 1>}$$

$$I_{OLED}=(\beta/2)(V_{GS}-V_{TH})^2=(\beta/2)(V_{GS}+|V_{TH}|)^2=(\beta/2)(V_{DD}-V_{DATA})^2 \quad \text{<Formula 2>}$$

As expressed in Formula 2, a current flowing through the OLED illustrated in FIG. 6 corresponds to $V_{DD}-V_{DATA}$ regardless of the threshold voltage $V_{TH}$ of the driving transistor MD. That is, a variation of the threshold voltage of the driving transistor MD can be compensated using the pixel circuit. Accordingly, the organic light emitting display apparatus having a uniform screen can be obtained. In various aspects, β is a predetermined value.

Figure 9A:
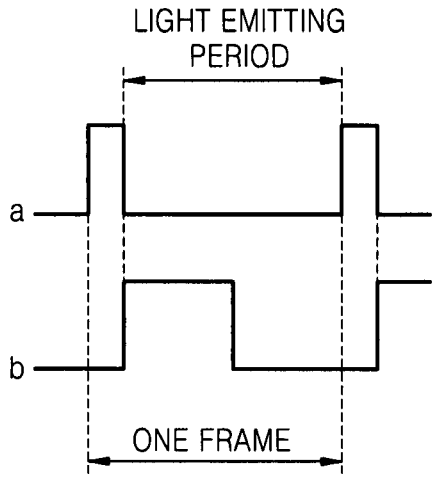
FIGS. 9A and 9B are diagrams illustrating generation of a second emission signal from a first emission signal and an emission duty control signal according to an aspect of the present invention.
Figure 9B:
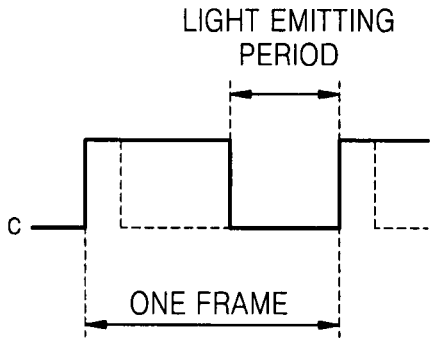

FIGS. 9A and 9B are diagrams illustrating generation of a second emission signal c from a first emission signal a and an emission duty control signal b according to an aspect of the present invention.

Referring to FIGS. 9A and 9B, the first emission signal a, having a fixed pattern, is combined with the emission duty control signal b in order to output the second emission signal c which controls on/off of an OLED. In the non-limiting aspect shown, the combination of a and b generates c by way of logic operation OR. In other aspects, other logic operations are possible.

Figure 10:
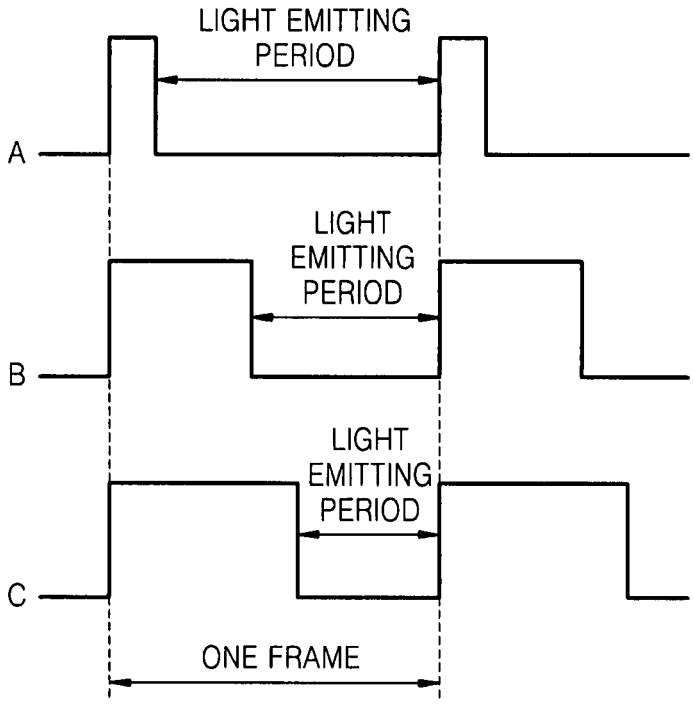
FIG. 10 includes diagrams illustrating second emission signals to control emission duty of an organic light emitting device based on basic information to reduce motion blurring.

FIG. 10 includes diagrams illustrating second emission signals A, B, and C to control emission duty of an OLED based on basic information to reduce motion blurring. Referring to FIG. 10, the emission duty of the second emission signal A is relatively large, the emission duty of the second emission signal B is relatively medium, and the emission duty of the second emission signal C is relatively small. As the emission duty decreases from A to C, brightness is reduced, but motion blurring is reduced.

Figure 11:
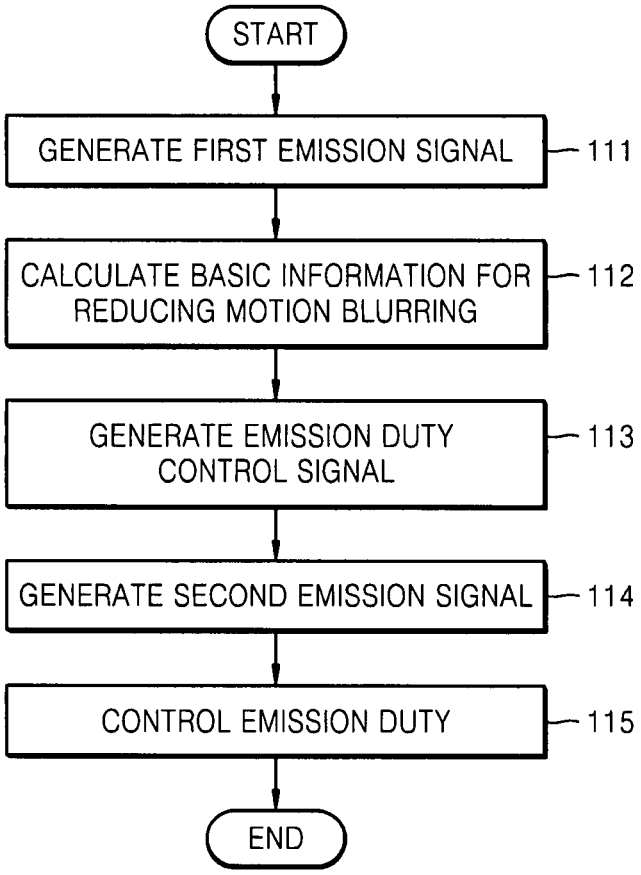
FIG. 11 is a flowchart illustrating a method of driving an organic light emitting display apparatus according to an aspect of the present invention.

FIG. 11 is a flowchart illustrating a driving method of an organic light emitting display apparatus according to an aspect of the present invention. Referring to FIG. 11, the driving method of the organic light emitting display apparatus includes generating a first emission signal (operation 111), calculating basic information to reduce motion blurring (operation 112), generating an emission duty control signal (operation 113), generating a second emission signal (operation 114), and controlling emission duty (operation 115).

In the non-limiting aspect shown, in operation 111, the first emission signal is generated. In operation 112, the basic information to reduce motion blurring is calculated. The basic information to reduce motion blurring may be a variation of data signal applied to data lines of the organic light emitting display apparatus, the brightness of each frame of the data signal applied to the data lines of the organic light emitting display apparatus, the external illumination of the organic light emitting display apparatus, or any combinations thereof.

In operation 113, the emission duty control signal is generated based on the basic information. When the basic information is the variation of the data signal, the emission duty control signal, which provides lower emission duty corresponding to an increase in the variation of the data signal, is generated. When the basic information is the brightness, the emission duty control signal, which provides lower emission duty corresponding to an increase in the brightness, is generated. When the basic information is the external illumination, the emission duty control signal, which provides lower emission duty corresponding to an increase in the external illumination, is generated. In other aspects, emission duty signal corresponding to a change in the variation of the data signal, the brightness, the external illumination, or any combination thereof, is generated.

In operation 114, the second emission signal is generated with reference to the first emission signal and the emission duty control signal. The second emission signal can be generated by an OR gate. In other aspects, a gate equivalent in logic operation as the OR gate may be used. In other aspects, other logic operations may be used.

In operation 115, motion blurring is selectively reduced by controlling the emission duty of the OLED using the second emission signal.

In other aspects, the operations of FIG. 11 may be branched so that operation 111 is performed on a first branch, and operations 112 and 113 are performed on a second branch, and both branches are brought together in operation 114. In this aspect, operation 111 may be performed simultaneously with operations 112 and 113.

Another description of the driving method of FIG. 11 is presented in the above section where the organic light emitting display apparatus according to the present invention is described.

Aspects of the present invention can also be embodied as computer readable codes on a computer (all apparatus that has an information processing function) readable recording medium. The computer readable recording medium is any data storage device that can store data which can thereafter read by a computer system. Examples of the computer readable recording medium includes read-only memory (ROM), random-access memory (RAM), CD-ROMs, magnetic tapes, floppy disks, optical data storage device, other volatile and/or non-volatile memory, or any combinations thereof.

Using the organic light emitting display apparatus and the method of driving the same according to various aspects of the present invention, motion blurring, generated while driving an organic light emitting display, can be reduced and/or removed, while brightness reduction and a power consumption increase can be minimized.

Although a few aspects of the present invention have been shown and described, it would be appreciated by those skilled in the art that changes may be made in the aspects without departing from the principles and spirit of the invention, the scope of which is defined in the claims and their equivalents.

What is claimed is:

1. An organic light emitting display apparatus comprising:

a plurality of pixels, each of the pixels including an organic light emitting device and a pixel circuit;

a data driving unit to apply a data signal to data lines connected to the pixels;

a scan driving unit to apply a selection signal to selection scan lines connected to the pixels;

an emission signal generating unit to generate a first emission signal;

an emission duty controlling unit to calculate basic information to reduce motion blurring and generate an emission duty control signal based on the basic information;

a logic gate to output a second emission signal based on the first emission signal and the emission duty control signal; and an emission driving unit to apply the second emission signal to emission scan lines connected to the pixels, wherein the emission duty controlling unit comprises:

a data variation calculating unit to measure a variation of the data signal; and an emission duty control signal generating unit to generate the emission duty control signal based on the variation of the data signal.

2. The organic light emitting display apparatus of claim 1, wherein the emission duty controlling unit generates the emission duty control signal to provide lower emission duty corresponding to higher variation of the data signal.

3. The organic light emitting display apparatus of claim 1, wherein the emission duty controlling unit further comprises a brightness calculating unit to calculate each frame brightness of the data signal, and wherein the emission duty control signal generating unit is further configured to generate the emission duty control signal based on the frame brightness of the data signal.

4. The organic light emitting display apparatus of claim 3, wherein the emission duty controlling unit generates the emission duty control signal to provide lower emission duty corresponding to higher frame brightness.

5. The organic light emitting display apparatus of claim 1, wherein the emission duty controlling unit further comprises an external illumination calculating unit to measure external illumination of the organic light emitting display apparatus, and wherein the emission duty control signal generating unit is further configured to generate the emission duty control signal based on the external illumination.

6. The organic light emitting display apparatus of claim 5, wherein the emission duty controlling unit generates the emission duty control signal to provide lower emission duty corresponding to higher external illumination.

7. The organic light emitting display apparatus of claim 1, wherein the logic gate is an OR gate.

8. The organic light emitting display apparatus of claim 1, wherein the selection scan lines comprise a first selection scan line and a second selection scan line, the pixel circuit comprises a first switching transistor, a second switching transistor, a first capacitor, a second capacitor, and a driving transistor, wherein the first switching transistor transmits a data voltage, that is applied to the data line, in response to a first selection signal applied to the first selection scan line, the first capacitor stores a voltage corresponding to a threshold voltage of the driving transistor, the second capacitor stores a voltage corresponding to the data voltage transmitted from the first switching transistor, the second switching transistor connects a power supply line to a terminal of the first capacitor in response to a second selection signal applied to the second selection scan line, and the driving transistor supplies a current from the power supply line to the organic light emitting device in correspondence to the voltages stored in the first and second capacitors.

9. The organic light emitting display apparatus of claim 8, wherein the pixel circuit further comprises a third switching transistor which diode-connects the driving transistor in response to the second selection signal.

10. The organic light emitting display apparatus of claim 8, wherein the pixel circuit further comprises a fourth switching transistor to break the connection between the driving transistor and the organic light emitting device in response to the emission signal applied to the emission scan line.

11. A method of driving an organic light emitting display apparatus, the method comprising:

generating a first emission signal;

calculating basic information to reduce motion blurring;

generating an emission duty control signal based on the basic information;

generating a second emission signal from the first emission signal and the emission duty control signal; and selectively reducing the motion blurring by controlling an emission duty of an organic light emitting diode using the second emission signal, wherein the basic information to reduce the motion blurring comprises a variation in a data signal applied to data lines of the organic light emitting display apparatus.

12. The method of claim 11, wherein the emission duty control signal provides lower emission duty corresponding to higher variation of the data signal.

13. The method of claim 11, wherein the basic information to reduce the motion blurring is one of the variation in the data signal and a frame brightness of the data signal applied to the data lines of the organic light emitting display apparatus.

14. The method of claim 13, wherein when the basic information to reduce the motion blurring is the frame brightness of the data signal, the emission duty control signal provides lower emission duty corresponding to higher frame brightness.

15. The method of claim 11, wherein the basic information to reduce the motion blurring is one of the variation in the data signal and an external illumination of the organic light emitting display apparatus.

16. The method of claim 15, wherein when the basic information to reduce the motion blurring is external illumination of the organic light emitting display apparatus, the emission duty control signal provides lower emission duty corresponding to higher external illumination.

17. The method of claim 11, wherein the second emission signal is generated by an OR logic operation of the first emission signal and the emission duty control signal.

18. An organic light emitting display apparatus, comprising:

at least one pixel;

a data driver to apply a data signal to the at least one pixel;

a scan driver to apply a selection signal to the at least one pixel; and an emission driver to apply an emission signal to the at least one pixel, wherein the emission signal having been generated using a filter signal to control an amount of light emitting period of the emission signal; and a filter device to generate the filter signal based on at least one of a variation, a brightness, or an external illumination level of an RGB data signal applied also to the data driver, wherein the filter signal is varied based on the data signal applied to data lines of the organic light emitting display apparatus and calculated to reduce motion blurring, and wherein the filter signal is generated when the variation, the brightness, and the external illumination level of the RGB data signal is greater than one or more predetermined levels.

19. The organic light emitting display apparatus of claim 18, wherein the filter signal is used to reduce motion blurring.

20. The organic light emitting display apparatus of claim 19, wherein a relationship between the light emitting period and reduction in the motion blurring is non-linear.

* * * * *